US010054293B2

(12) United States Patent
Guercio et al.

(10) Patent No.: US 10,054,293 B2
(45) Date of Patent: Aug. 21, 2018

(54) LIGHT FIXTURE DEVICE MOUNTING PLUG

(71) Applicant: RAB Lighting Inc., Northvale, NJ (US)

(72) Inventors: Vincenzo Guercio, Wallkill, NY (US); Wengang Gao, Ningbo (CN)

(73) Assignee: RAB Lighting Inc., Northvale, NJ (US)

( * ) Notice: Subject to any disclaimer, the term of this patent is extended or adjusted under 35 U.S.C. 154(b) by 111 days.

(21) Appl. No.: 15/137,642

(22) Filed: Apr. 25, 2016

(65) Prior Publication Data

US 2016/0312983 A1 Oct. 27, 2016

Related U.S. Application Data

(60) Provisional application No. 62/152,800, filed on Apr. 24, 2015.

(51) Int. Cl.

| | |
|---|---|
| ***F21V 33/00*** | (2006.01) |
| ***F21V 17/00*** | (2006.01) |
| ***F21V 15/01*** | (2006.01) |
| ***F21V 17/02*** | (2006.01) |
| ***F21V 23/04*** | (2006.01) |
| *F21V 31/00* | (2006.01) |
| *F21V 21/30* | (2006.01) |

(52) U.S. Cl.

CPC ..... *F21V 17/002* (2013.01); *F21V 15/01* (2013.01); *F21V 17/02* (2013.01); *F21V 23/0464* (2013.01); *F21V 21/30* (2013.01); *F21V 31/00* (2013.01)

(58) Field of Classification Search

CPC ..... F21V 17/002; F21V 17/02; F21V 23/0464

USPC ..... 362/95, 645, 647, 650, 276

See application file for complete search history.

(56) References Cited

U.S. PATENT DOCUMENTS

| | | | | |
|---|---|---|---|---|
| 3,027,416 | A * | 3/1962 | Kissel | H02G 3/185 174/57 |
| 3,358,870 | A | 12/1967 | Larkins | |
| 3,991,446 | A * | 11/1976 | Mooney | F16C 33/20 138/108 |
| 4,302,035 | A | 11/1981 | Ochwat | |
| 5,912,431 | A | 6/1999 | Sheehan | |
| 6,091,200 | A | 7/2000 | Lenz | |
| 6,555,750 | B2 | 4/2003 | Kiely | |

(Continued)

FOREIGN PATENT DOCUMENTS

| | | |
|---|---|---|
| CA | 140798 | 1/2012 |
| CN | 201130171304.1 | 11/2011 |

(Continued)

*Primary Examiner* — Paultep Savusdiphol

(74) *Attorney, Agent, or Firm* — SmithAmundsen LLC; Dennis S. Schell; Kevin C. Oschman

(57) ABSTRACT

A light fixture includes a housing enclosing a light source. The housing defines an opening therethrough. A plug, which is receivable within the opening, includes a face having a central knockout portion. A perimeter of the knockout portion defines an opening size smaller than an opening size of the opening. According to alternative configurations, the plug may be removed from the opening or only the knockout portion may be removed from the plug while leaving a remainder of the plug in the opening. As such, different sized openings through the light fixture housing may be provided for installation of various light fixture accessories.

20 Claims, 7 Drawing Sheets

(56) References Cited

U.S. PATENT DOCUMENTS

| | | | | |
|---|---|---|---|---|
| 6,940,012 | B2 * | 9/2005 | Case | H02G 3/085 174/50 |
| 7,332,678 | B2 * | 2/2008 | Pyron | B60R 16/0222 174/660 |
| D643,147 | S | 8/2011 | Guercio et al. | |
| 8,410,378 | B1 | 4/2013 | Senseney et al. | |
| 8,809,701 | B2 | 8/2014 | Levi | |
| 9,273,863 | B2 | 3/2016 | Guercio et al. | |
| 2005/0087354 | A1 * | 4/2005 | Case | H02G 3/085 174/50 |
| 2005/0230141 | A1 * | 10/2005 | Case | H02G 3/085 174/666 |
| 2006/0201957 | A1 * | 9/2006 | Harrington | H02G 3/085 220/787 |

FOREIGN PATENT DOCUMENTS

| | | |
|---|---|---|
| CN | ZL201220475032.3 | 7/2013 |
| MX | 36757 | 7/2012 |
| TW | 458690 | 10/2001 |
| TW | 391775 | 4/2013 |
| TW | D160717 | 5/2014 |

* cited by examiner

LIGHT FIXTURE DEVICE MOUNTING PLUG

CROSS-REFERENCE TO RELATED APPLICATIONS

This application claims the benefit of U.S. Provisional Patent Application No. 62/152,800, filed Apr. 24, 2015, and titled LIGHT FIXTURE PLUG, which is incorporated herein by reference.

TECHNICAL FIELD

The present disclosure relates generally to light fixtures, and more particularly to openings through light fixture housings and plugs therefor.

BACKGROUND

There is a considerable amount of energy wasted in light fixture applications by keeping lights on when not needed. However, there are commercially available automated controls available for consumers to control lighting. For example, timers can turn on lights based on time of day, motion detecting sensors can be used to switch on power to light fixtures based on detected movement, and photocells or photo sensors can switch on power based on levels of ambient light. Consumers are faced with the economic decision of weighing the costs and benefits of incorporating such sensors and devices into their light fixtures. For consumers that choose to implement energy-saving lighting devices, or other devices, a need has developed for optionally integrating such sensors and devices into light fixture housings.

Drilling for and mounting sensors and devices on light fixtures is an expensive and time-consuming process. Such devices are available in different types and sizes and, as a result, require different opening sizes and/or opening types for installation. For each different device, a unique opening corresponding to the device must be drilled through the light fixture housing before the device can be installed.

It is an object of the present invention to provide a light fixture that accommodates selective introduction of different types and/or sizes of devices or wiring into its interior while maintaining an environmental barrier and without adding the expense and inconvenience of drilling additional openings into the light fixture. The present disclosure is responsive to such an endeavor and is directed to one or more of the problems or issues set forth above.

SUMMARY OF THE DISCLOSURE

In one aspect, a light fixture includes a housing enclosing a light source, the housing having an opening defined therethrough. The opening is optionally defined in a removable plate or cover portion of the housing. A plug, which is receivable within the opening, includes a face having a knockout portion that is at least partly aligned with the opening when the plug is received within the opening. A perimeter of the knockout portion defines an opening size different than an opening size of the opening.

DETAILED DESCRIPTION

Figure 1:
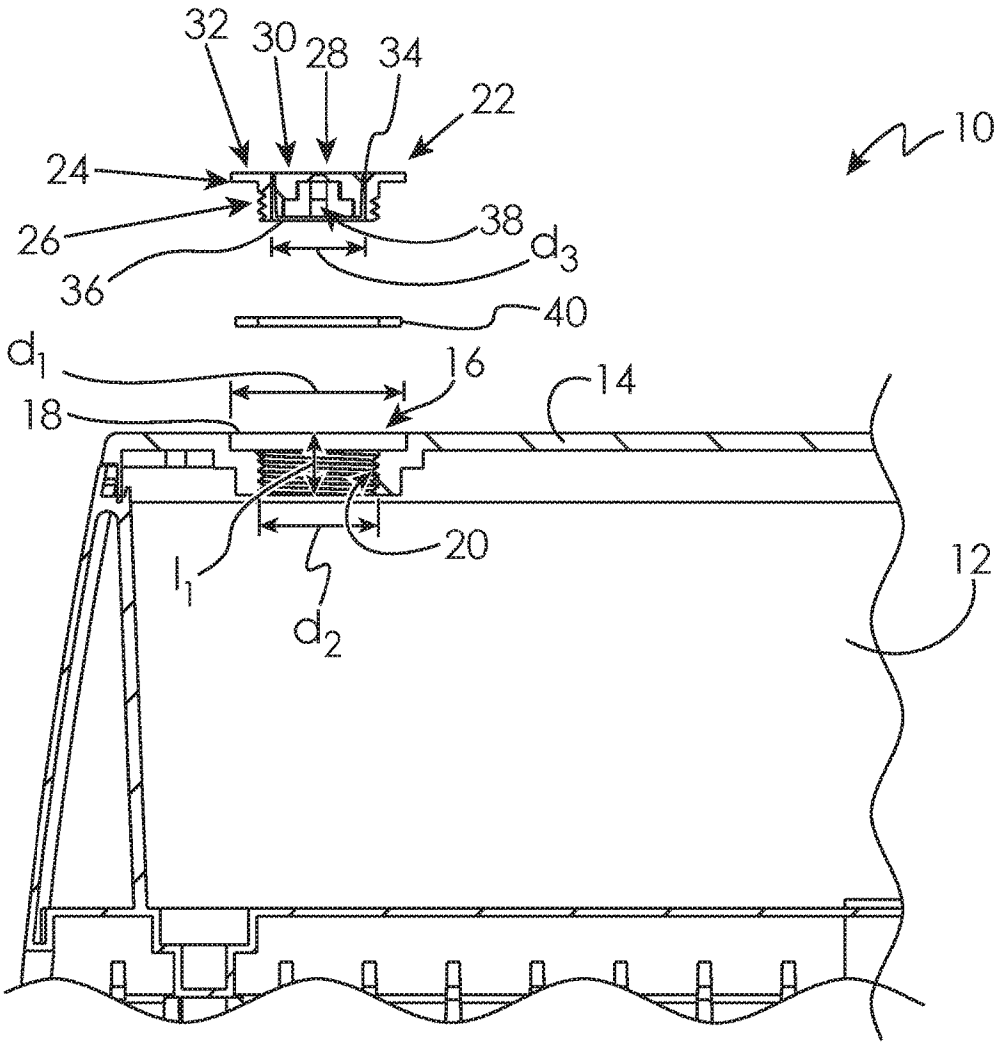
FIG. 1 is an exploded cross-section view of a portion of a housing of an exemplary light fixture according to the present disclosure, with a plug shown removed from an opening through the housing.

A portion of an exemplary light fixture according to the present disclosure is shown generally at 10 in FIG. 1. The light fixture 10, discussed in greater detail below, may be a known light fixture, including a housing 12 defined in part by a plate 14. According to the exemplary embodiment, the housing 12 includes a plate 14 which may be a back cover of the housing 12 and may function to enclose and/or support components of the light fixture 10. Additional plates and/or other components may be provided to complete the housing 12.

According to the present disclosure, the plate 14 includes an opening 16 therethrough; however, opening 16 may alternatively be defined through other portions of the housing. As shown, the opening 16 may be circular and may have different surfaces along a length, or depth, l1 of the opening 16. For example, the opening 16 may be defined in part by an interference surface 18 such as a counterbore 18 and in part by a threaded surface 20. Although not necessary, the counterbore 18 may have a diameter d1 greater than a diameter d2 of the threaded surface 20. As such the opening size, which may be defined by the diameter d1, of the counterbore 18 may be greater than the opening size, defined by the diameter d2, of the threaded surface 20. According to the exemplary embodiment, the opening size defined by the threaded surface 20 may represent the diameter d2 or opening size of the opening 16. According to some embodiments, the dimensions of the threaded surface 20 of the opening 16 are compatible with the one-half inch Nominal Pipe Size (NPS) standard.

A plug 22, according to the present disclosure, is receivable within the opening 16. That is, the plug 22 may be shaped and configured for achieving a fixed attachment or coupling with the housing 12 at the opening 16. According to the exemplary embodiment, the plug 22 may include an exterior fitting surface or flange 24 complementary to the counterbore 18 of the opening 16. In addition, the plug 22 may include a cylindrical body defining an exterior threaded surface 26 configured for engagement with the threaded surface 20 of the opening 16. That is, the shape, size, and configuration of the plug 22 may be selected to mate or form a fixed engagement with the opening 16.

The plug 22 also includes a face 28 having a knockout portion 30 that is at least partly aligned with the opening 16 when the plug 22 is received within the opening 16. According to the exemplary embodiment, a top 32, which includes the face 28, of the plug 22 includes a thinned section defining a perimeter 34 of the knockout portion 30. For example, the thinned section of material at perimeter 34 is sufficiently weak to remove knockout portion 30 from the flange 24 by tapping with a tool, rather than requiring a hole punching tool, drill, or other boring tooling to form an opening therethrough. As shown, the perimeter 34 of the knockout portion 30 can be central to the plug 22 and may define a passageway having an opening size different than an opening size of the opening 16. In particular, for example, the knockout portion 30 may have a diameter d3 less than the diameter d2 of the threaded surface 20 of the opening 16.

The plug 22 also includes an inner surface 36 opposite the exterior threaded surface 26. In addition, according to the exemplary embodiment, the plug 22 includes rotational drive profile 38, operable in a known fashion, e.g. engagement and rotation with a screw driver or other rotational drive tool, for securing the plug 22 within the opening 16. The rotational drive profile 38 is provided on an internal side of the plug 22 to provide a clean appearance of the exterior of the housing 12 when the plug 22 is received within the opening 16. A seal 40, which may be seated at an interface of the plug 22 and the housing 12 when the plug 22 is received within the opening 16, may also be provided. The seal 40 may assist in forming an environmental barrier at the interface of the plug 22 and the housing 12 when the plug 22 is received within the opening 16.

Figure 2:
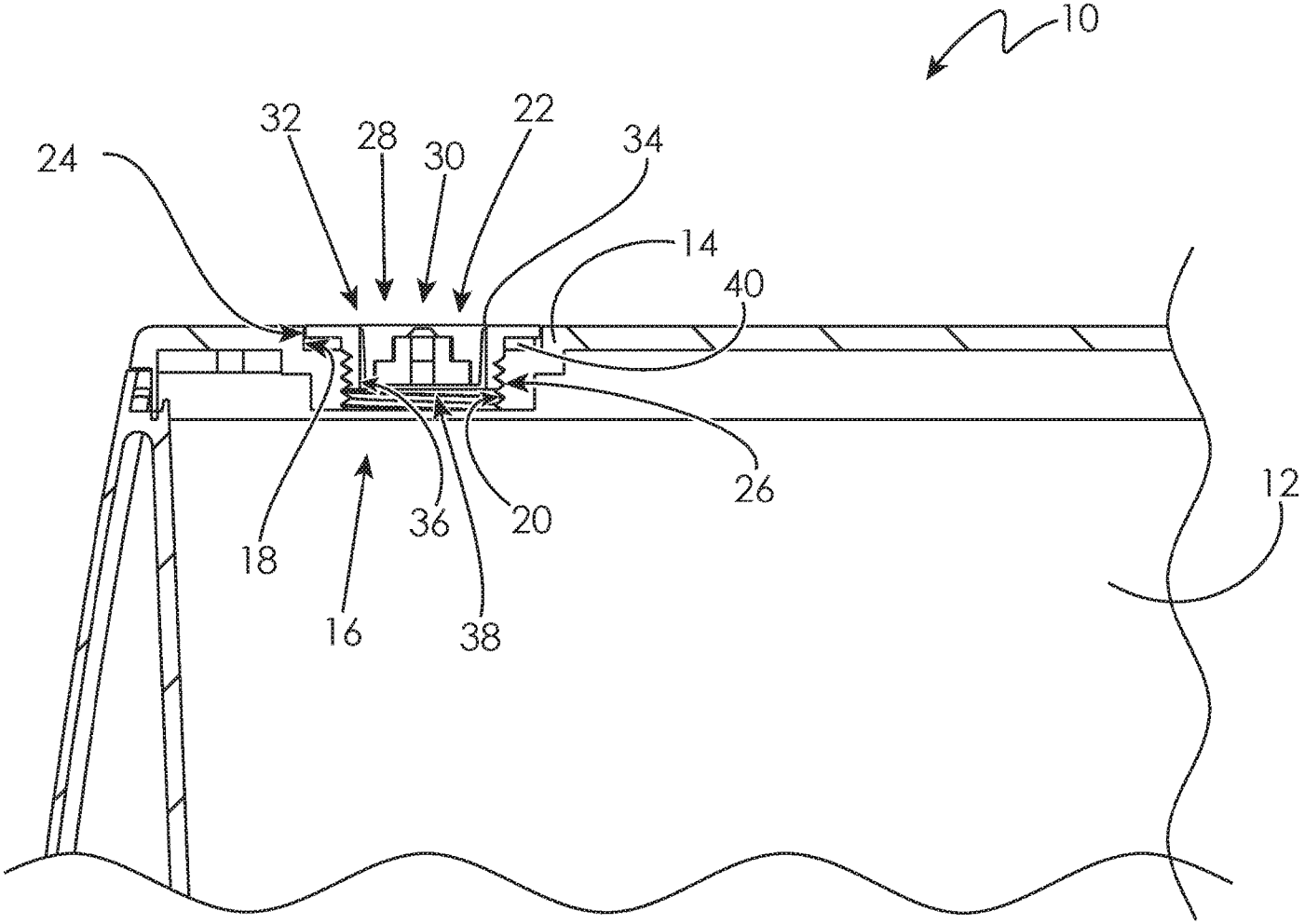
FIG. 2 is a cross-section view of the housing portion of FIG. 1, with the plug received within the opening.

Turning now to FIG. 2, the plug 22 is shown threadably received within the opening 16. According to the exemplary embodiment, the interference and fitting surfaces 18 and 24 may form an interference fit when the plug 22 is threadably received, or screwed, within the opening 16. Additionally, the seal 40 may be compressed in this coupled, or installed, configuration of the plug 22. This configuration, in which the plug 22 is received in the opening 16, may be provided during manufacture and may provide a means for quickly and easily installing various light fixture accessories after manufacture, as will be described below.

Figure 3:
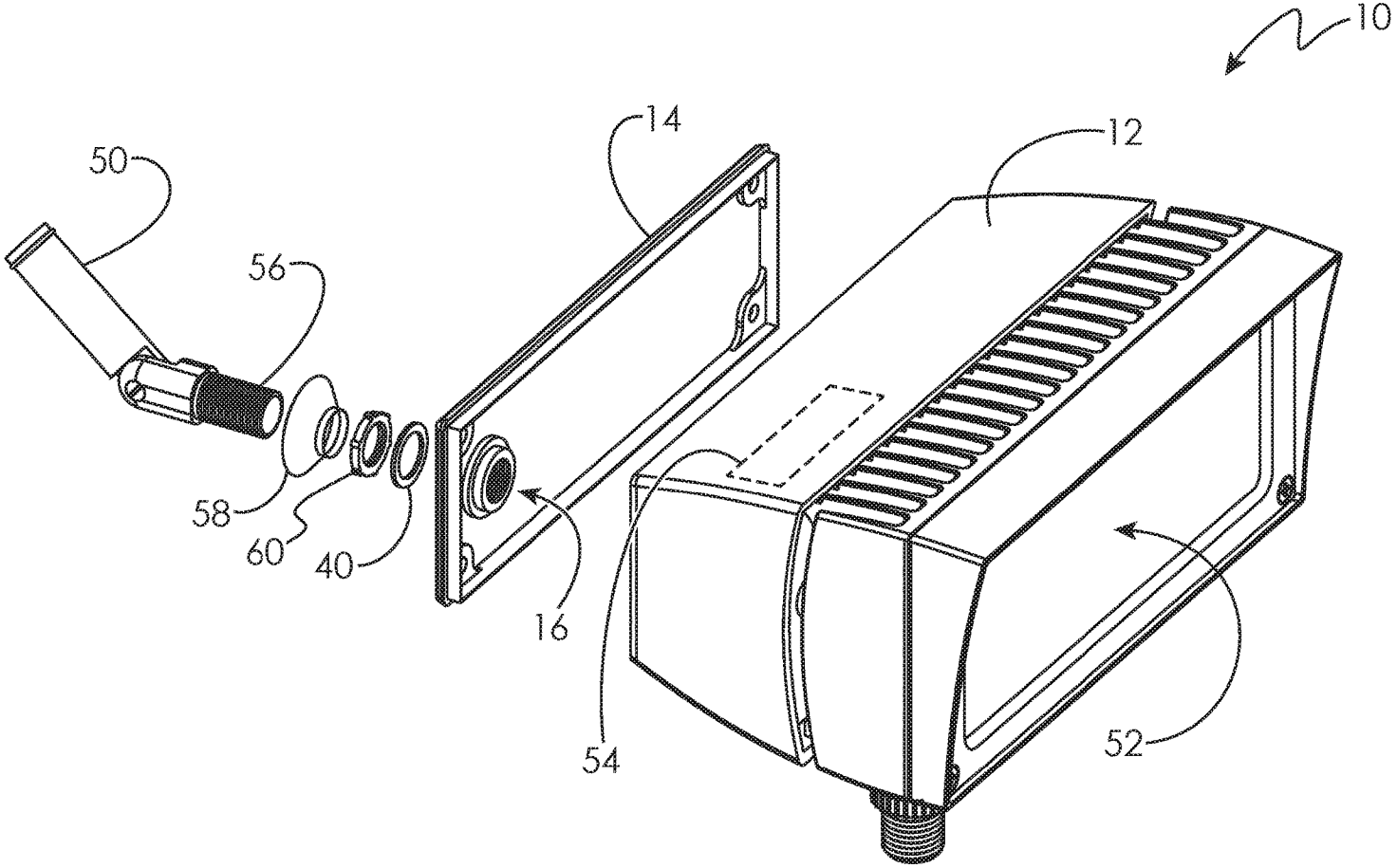
FIG. 3 is a perspective view of the exemplary light fixture of FIG. 1, shown with a plate of the housing removed and a swivel photocell device and additional components shown in exploded fashion.

For example, the exemplary light fixture 10 is shown in FIG. 3 with the back plate 14 removed, for illustrative purposes, and a swivel photocell device 50 and additional components to be installed relative to the light fixture 10 shown in exploded fashion. The housing 12 of the light fixture 10, shown in its entirety in this FIG., may enclose a light source 52 and a power supply 54 (which is not visible since it is enclosed within the housing 12) supplying power to the light source 52. For example, the light source 52 may include one or more light emitting devices, such as light emitting diodes. However, alternative light sources or light producing devices, including conventional light sources, may also be used with the light fixture 10. The power supply 54 may, for example, be a driver configured for driving the one or more light emitting devices in a known manner, or may be an alternative driver or power supply for operating an alternative light source. According to some embodiments, the light fixture 10 may also include an electrical junction box, which includes, supports, or joins electrical wires, and additional components common in lighting fixtures, such as, for example, doors, lenses, reflectors, and the like.

Figure 5:
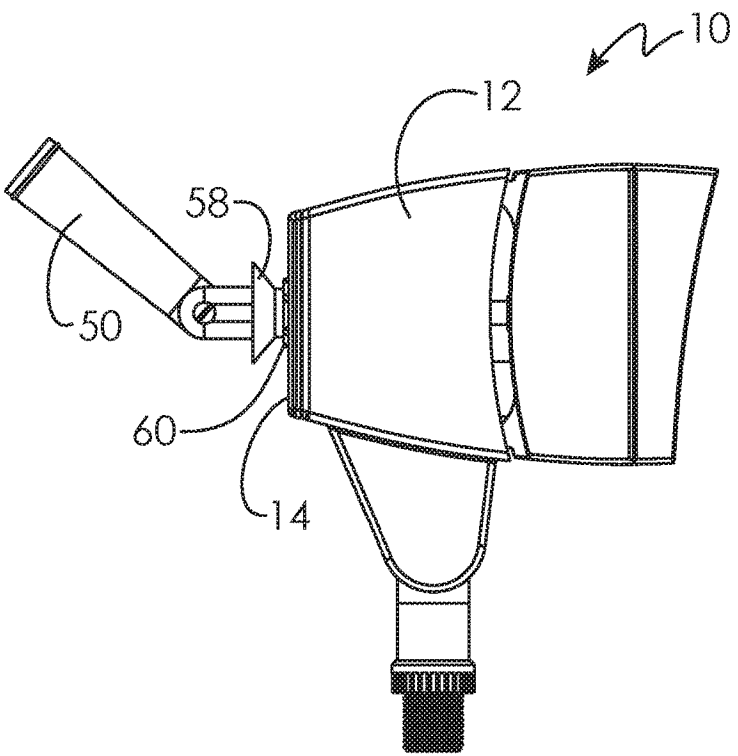
FIG. 5 is a side view of the exemplary light fixture, with the swivel photocell coupled thereto.
Figure 4:
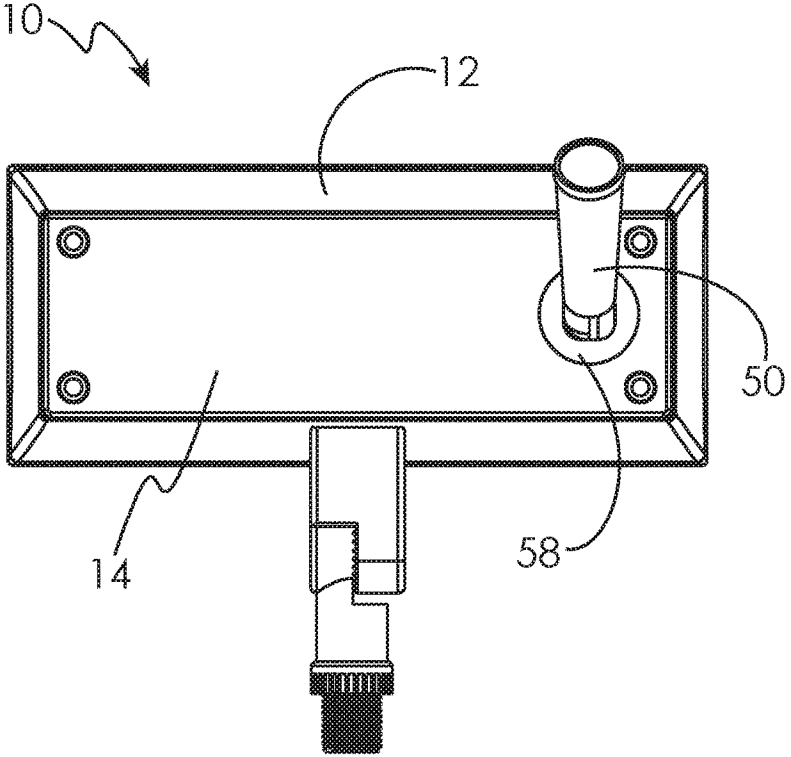
FIG. 4 is a rear end view of the exemplary light fixture, with the swivel photocell shown coupled to the light fixture.

According to one example, installation of the swivel photocell device 50, equipped with a threaded extension 56, relative to the light fixture 10 may include removal of the back plate 14 from the remainder of the housing 12 in a known fashion. The plug 22 (not shown in FIG. 3) may then be removed from the opening 16 through the back plate 14, such as by using the rotational drive profile 38, to reveal the counterbore 18 and threaded surface 20 of the opening 16. To install the swivel photocell device 50, according to the exemplary embodiment, the threaded extension 56 of the swivel photocell device 50 may be inserted through a device gasket 58, threaded into the device lock ring 60, inserted through the seal 40, and threaded into the opening 16. FIG. 4 is a rear end view of the exemplary light fixture 10, with the swivel photocell device 50 shown coupled to the light fixture 10, and FIG. 5 is a side view of the exemplary light fixture 10, with the swivel photocell device 50 coupled thereto.

Figure 6:
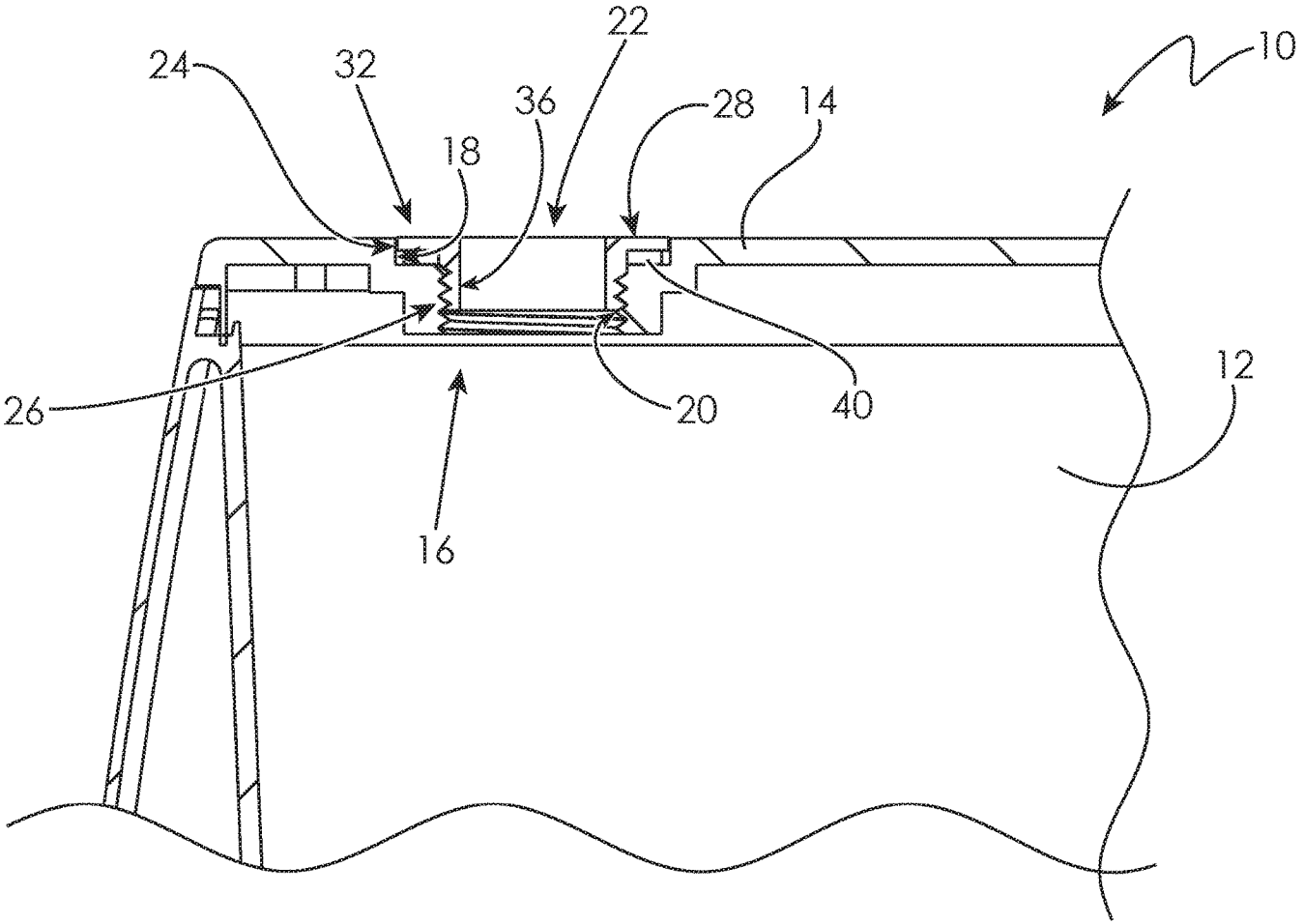
FIG. 6 is a cross-section view of the housing portion of FIGS. 1 and 2, shown with a knockout portion of the plug removed while a remainder of the plug is received within the opening.
Figure 7:
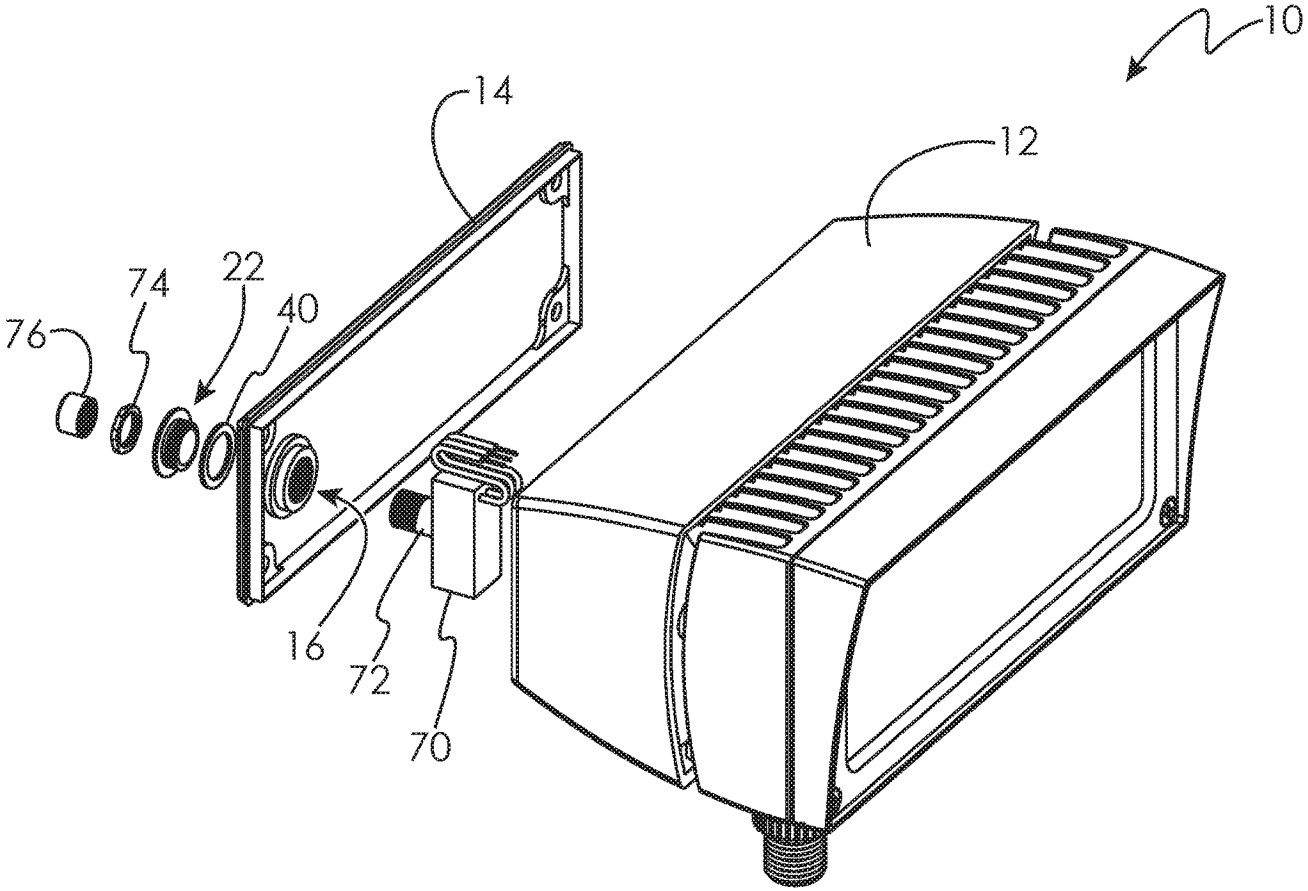
FIG. 7 is a perspective view of the exemplary light fixture, shown with a plate of the housing removed and a button photocell device and additional components shown in exploded fashion.

According to an alternative configuration, shown in FIG. 6, the knockout portion 30 may be removed from the plug 22 while leaving a remainder of the plug 22 in the opening 16 to reveal the inner surface 36 of the plug 22. This configuration may be used to install a quick-connect device, sensor, conduit, or the like. For example, the exemplary light fixture 10 is shown in FIG. 7 with the back plate 14 removed, for illustrative purposes, and a button photocell device 70 and additional components to be installed relative to the light fixture 10 shown in exploded fashion. To install the button photocell device 70, the back plate 14 may be removed from the remainder of the housing 12 in a known fashion. The knockout portion 30 may be removed from the plug 22 in a known fashion while leaving a remainder of the plug 22, and seal 40, in the opening 16. To install the button photocell device 70, according to the exemplary embodiment, an extension 72 of the button photocell device 70 is inserted through a back-side of the remainder of the plug 22 (with knockout portion 30 removed). A quick-connect device gasket 74 is placed around the extension 72 outside of the back plate 14, and a quick-connect locking mechanism 76 is coupled to the extension 72 of the button photocell device 70.

Figure 9:
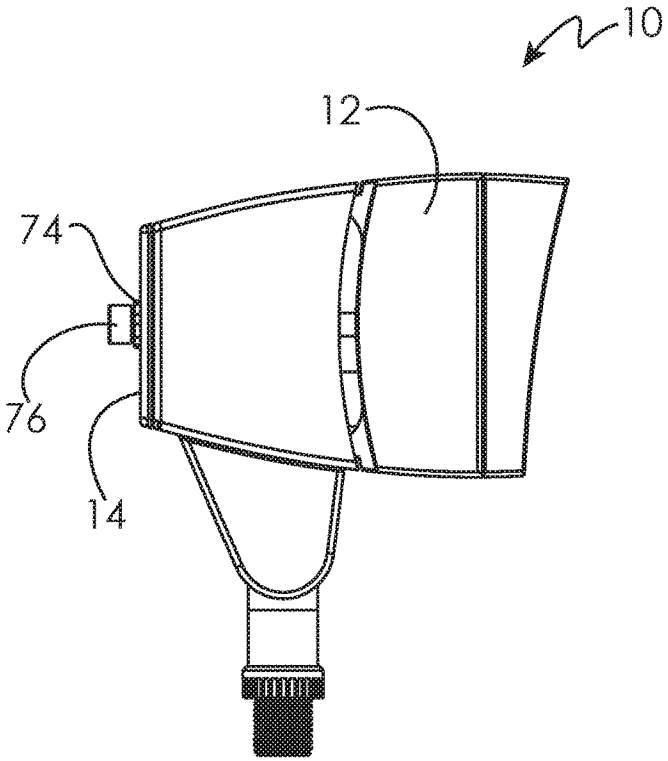
FIG. 9 is a side view of the exemplary light fixture, with the button photocell device coupled thereto.
Figure 8:
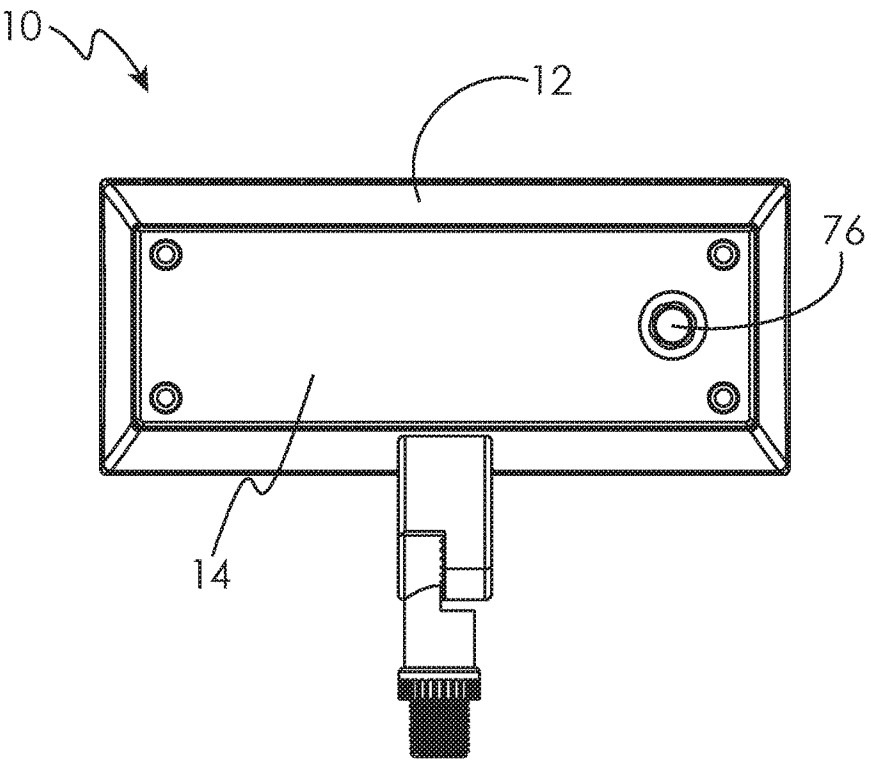
FIG. 8 is a rear end view of the exemplary light fixture, with the button photocell device shown coupled to the light fixture.

FIG. 8 is a rear end view of the exemplary light fixture 10, with the button photocell device 70 shown coupled to the light fixture 10, and FIG. 9 is a side view of the exemplary light fixture 10, with the button photocell device 70 coupled thereto.

Housing 12 and plug 22 can be formed from the same or different materials, as are known in the art, for example diecast aluminum.

Thus, according to the present disclosure, different sized openings through the light fixture housing 12 may be provided for installation of various light fixture accessories or devices. For example, the plug 22 may be removed in its entirety from the housing 12, exposing the threaded surface 20 of the opening 16, for the installation of a threaded screw-drive device, sensor, conduit, or the like. Alternatively, only the knockout portion 30 of the plug 22 may be removed, exposing the inner surface 36 of the plug 22, for the installation of a quick-connect device, sensor, conduit or the like. Although the plug 22 and knockout portion 30 are shown having particular shapes and sizes, they can be sized and shaped differently to accommodate various through-hole or quick-connect devices, sensors, conduits, or the like. As such, significant time and expense can be saved when fitting various accessories relative to light fixtures.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A light fixture, comprising:

a housing enclosing a light source;

the housing having an opening defined therethrough;

a plug receivable within the opening;

the plug including a face having a knockout portion that is at least partly aligned with the opening when the plug is received within the opening; and a perimeter of the knockout portion defining an opening size different than an opening size of the opening.

2. The light fixture of claim 1, wherein the opening is circular and a portion of the plug received within the opening is circular.

3. The light fixture of claim 2, wherein the opening is defined in part by a threaded surface and the plug may be threadably received within the opening.

4. The light fixture of claim 1, wherein the opening is defined in part by an interference surface and the plug includes an exterior fitting surface complementary to the interference surface.

5. The light fixture of claim 4, wherein the interference surface is a counterbore and the exterior fitting surface is a flange.

6. The light fixture of claim 4, wherein the opening is defined in part by a threaded surface and the plug includes an exterior threaded surface configured for engagement with the threaded surface of the opening.

7. The light fixture of claim 6, further including a rotational drive profile defined by the knockout and for rotationally securing the plug within the threaded opening.

8. The light fixture of claim 7, wherein the rotational drive profile is defined on a side of the knockout internal to the housing.

9. The light fixture of claim 4, further including an environmental barrier between the interference surface and the exterior fitting surface.

10. The light fixture of claim 1, wherein the knockout portion is central to the plug and upon separation from the plug, a passageway is defined through the plug.

11. The light fixture of claim 1, wherein a diameter of the knockout portion is less than a diameter of the opening.

12. The light fixture of claim 1, wherein the housing encloses a power supply coupled to the light source.

13. A device mounting plug for a housing, comprising:

a body defining an exterior threaded surface;

an interior passageway defined by an interior of the body;

a face defined at one end of the body, the face closing off an end of the interior passageway;

a knockout portion defined by a portion of the face and aligned with the interior passageway; and a rotational drive profile defined by the knockout portion for securing the exterior threaded surface to the housing.

14. The device mounting plug of claim 13, wherein the rotational drive profile is defined by the knockout portion on an end opposite the face.

15. The device mounting plug of claim 13, wherein a thickness of the face is thinned along a perimeter defining the knockout.

16. The device mounting plug of claim 13, wherein the face further defines a flange extending radially outward.

17. The device mounting plug of claim 16, wherein the flange and face form a planar surface.

18. A device mounting plug, comprising:

a cylindrical body having a first diameter and defining an exterior threaded surface;

an interior passageway defined by an interior surface of the body, extending a length of the body, and having a second diameter;

a face defined at one end of the body; and a knockout portion defined by a central portion of the face, aligned with the interior passageway, and having a diameter equal to the second diameter;

wherein the knockout portion includes a thinned section of material at its perimeter on the face which is sufficiently weak to remove the knockout portion from the face.

19. The mounting plug of claim 18, wherein the face includes a flange which is complementary to a counterbore on a housing of a light fixture.

20. The mounting plug of claim 18, further comprising a rotational drive profile defined by the knockout portion for securing the exterior threaded surface to a housing of a light fixture.

* * * * *